US008727400B1

(12) United States Patent
Marchand

(10) Patent No.: US 8,727,400 B1
(45) Date of Patent: May 20, 2014

(54) CONCEALED SECURITY BAR FOR A SLIDING DOOR

(76) Inventor: Duane T. Marchand, Vancouver, WA (US)

( * ) Notice: Subject to any disclaimer, the term of this patent is extended or adjusted under 35 U.S.C. 154(b) by 612 days.

(21) Appl. No.: 12/948,821

(22) Filed: Nov. 18, 2010

(51) Int. Cl.
*E05C 17/04* (2006.01)

(52) U.S. Cl.
USPC ..... 292/272; 292/259 R; 292/DIG. 15

(58) Field of Classification Search
USPC ..... 292/272, 259 R, 289
See application file for complete search history.

(56) References Cited

U.S. PATENT DOCUMENTS

| | | | | |
|---|---|---|---|---|
| 2,643,420 | A * | 6/1953 | Schwartz | 49/458 |
| 3,797,005 | A * | 3/1974 | Schwarz | 340/542 |
| 3,825,290 | A * | 7/1974 | Messina et al. | 292/262 |
| 4,073,522 | A * | 2/1978 | Tierney | 292/262 |
| 4,135,376 | A | 1/1979 | Evans et al. | |
| 4,314,721 | A | 2/1982 | Clark | |
| 4,429,912 | A | 2/1984 | Smith, Jr. | |
| 4,541,202 | A | 9/1985 | Dockery | |
| 4,572,557 | A * | 2/1986 | Taylor | 292/263 |
| 4,822,084 | A | 4/1989 | Fox | |
| 5,141,272 | A * | 8/1992 | Veillette | 292/338 |
| 2008/0018118 | A1 * | 1/2008 | Schultz | 292/259 R |

* cited by examiner

*Primary Examiner* — Mark Williams
(74) *Attorney, Agent, or Firm* — Montgomery Patent & Design; Robert C. Montgomery

(57) ABSTRACT

A concealed security bar comprising a concealing and deploying means for the security bar for a sliding patio door comprises a security bar, a lifting mechanism, and a releasing means. The security bar sits along a ground surface between a wall portion and a sliding door in order to prevent opening of the door. The lifting mechanism comprises a mechanism which pivots the bar into an upright position along the wall surface in order to allow the door to function as normal. The releasing means is located along the wall surface at a height easily accessible by a user. Upon depressing the releasing means, the lifting mechanism is activated in order to lift the bar without need for reaching down to the ground to grab the bar.

16 Claims, 7 Drawing Sheets

CONCEALED SECURITY BAR FOR A SLIDING DOOR

RELATED APPLICATIONS

The present invention was first described in a notarized Official Record of Invention on Feb. 11, 2010, that is on file at the offices of Montgomery Patent and Design, LLC, the entire disclosures of which are incorporated herein by reference.

FIELD OF THE INVENTION

The present invention relates generally to door security mechanisms, and in particular, to a manually actuated security bar for a sliding door.

BACKGROUND OF THE INVENTION

Sliding glass doors have achieved a prominence in modern architecture, combining the functionality and convenience of an entryway with the beauty and light transmitting qualities of a window. One (1) of the most popular usages of such sliding doors is as a means of accessing patios, decks, and similar structures. In general, these doors fit a double-wide opening and open or close by riding upon a sliding track frame.

While these doors are desirable for their aesthetic beauty and their convenient functionality, they do suffer from a drawback in that they are susceptible as a point of entry for burglars and thieves. The latches commonly used to lock sliding glass doors are easily manipulated with the use of a pry bar by forcing it between the jamb and the door and prying it open. Many owners place a stick in the lower track to eliminate the possibility of the door sliding open. However, such sticks are often unsightly. Furthermore, the use of such objects requires the user to bend over in order to position and retrieve the object during use.

Various attempts have been made to provide sliding door security devices. Examples of these attempts can be seen by reference to several U.S. patents. U.S. Pat. No. 4,135,376, issued in the name of Evans et al., describes a patio door security bar which is selectively lockable from within the interior of a housing to prevent lateral motioning of a patio door.

U.S. Pat. No. 4,429,912, issued in the name of Smith, Jr., describes a foldable security bar adaptable for permanent installation on sliding doors and windows with a movable latch for selectively unlocking the device.

U.S. Pat. No. 4,541,202, issued in the name of Dockery, describes a sliding door operator and lock including a gear-toothed rack and a motor driven gear for secure and selectable automatic electric operation of the device.

While these devices fulfill their respective, particular objectives, each of these references suffer from one (1) or more of the aforementioned disadvantages. Many such devices are difficult or time consuming to manipulate. Also, many such devices cause damage upon installation. Furthermore, many such devices are unsightly while in use, or even at all times. Accordingly, there exists a need for a security bar for sliding doors without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a security device for sliding doors which is quickly adjustable between locked and unlocked configurations in a concealed, aesthetic manner. Thus, the object of the present invention is to solve the aforementioned disadvantages and provide for this need.

To achieve the above objectives, it is an object of the present invention to selectively secure a sliding door in a closed position or disengage the door to allow opening. The apparatus comprises a channel, a releasing bar, and a securing bar.

Another object of the present invention is to enable a user to selectively manually secure or disengage the apparatus from the door.

Yet still another object of the present invention is to position the channel vertically within a vertical track of the sliding door in a concealed manner utilizing an interference fitting. The channel can be further secured utilizing a plurality of mechanical fasteners.

Yet still another object of the present invention is to allow a user to operate the apparatus without need for significant manual dexterity, bending over, or complexity. The vertical channel receives the releasing bar. The releasing bar is slidably movable within the channel and is constrained by an upper panel aperture and a retaining bracket.

Yet still another object of the present invention is to prevent opening of the sliding door in a concealed manner when the securing bar is positioned horizontally along a ground surface between the channel and the door. The securing bar is further pivotally attached to a lower portion of the channel by a pair of securing bar brackets.

Yet still another object of the present invention is to allow a user to quickly raise the securing bar to a disengaged vertical position by pressing downward on a top end of the releasing bar. As the releasing bar is depressed, it motions a securing bar spring within the channel. The securing bar spring is further attached to the securing bar at a proximal position such that the securing bar is pivoted upwardly into the channel as a result of the motion.

Yet still another object of the present invention is to automatically return the releasing bar to an initial position after depressing. This is accomplished by a slot within the channel which limits the lateral and vertical movement of the releasing bar and a releasing bar spring which returns the releasing bar to its initial resting state after use.

Yet still another object of the present invention is to automatically retain the securing bar within the channel. The retaining bracket comprises a magnetic material which releasably secures the securing bar in a disengaged position until the user returns the securing bar to a downward position to secure the door.

Yet still another object of the present invention is to provide a method of utilizing the device that provides a unique means of obtaining an instance of the apparatus of a desired size and shape for a particular sliding door, installing the channel within a vertical track of the sliding door in a concealed manner, selectively pivoting the securing bar downward along a horizontal ground surface in a concealed manner to prevent sliding opening of the door, depressing the top end of the releasing bar in order to pivot the securing bar upward, automatically retaining the securing bar in the upward disengaged position with the magnetic retaining bracket, pulling outward to release the securing bar from the retaining bracket and motioning the securing bar back downward to re-secure the door, and uninstalling the apparatus as desired.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
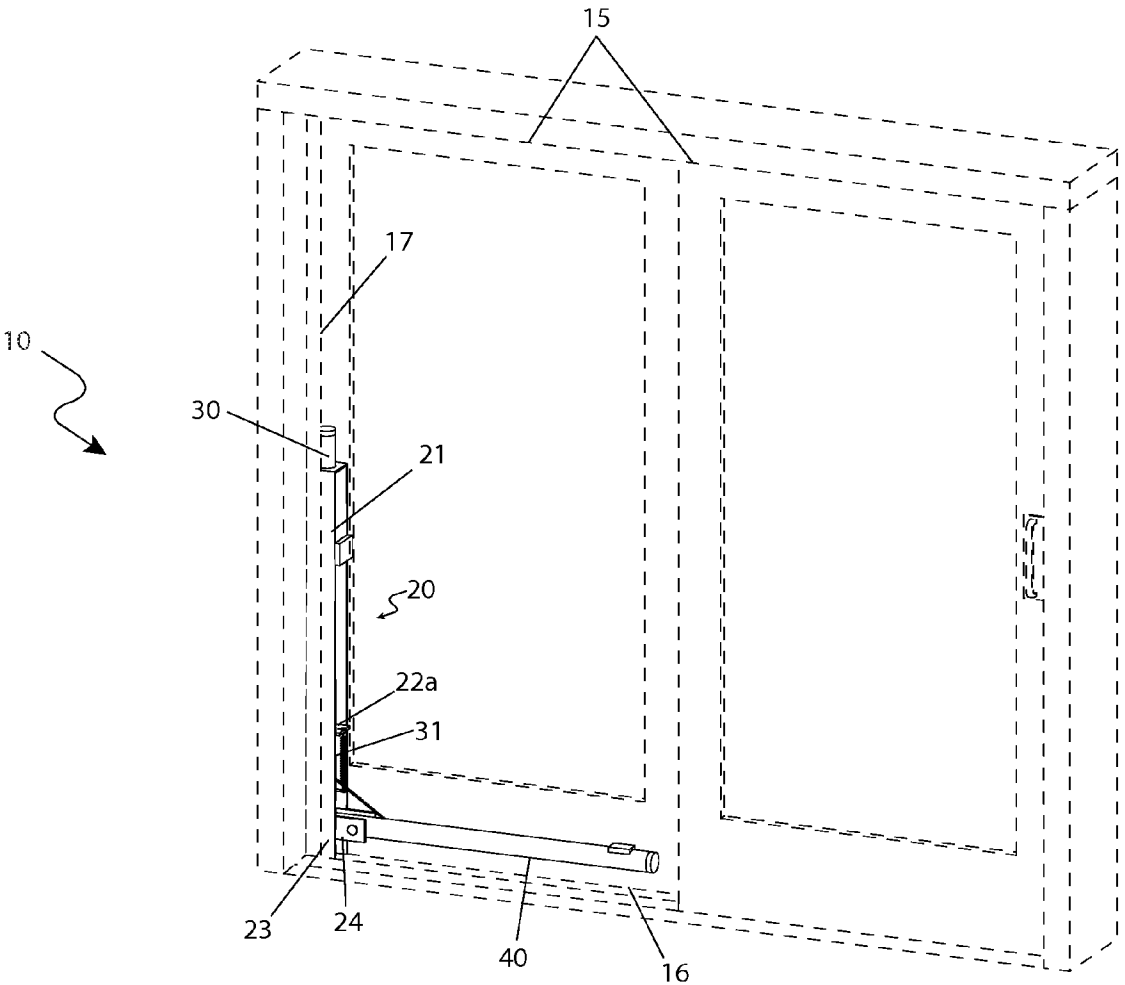
FIG. 1 is an environmental view of a concealed security bar for a sliding door 10, according to a preferred embodiment of the present invention.

10 concealed security bar for a sliding door
15 sliding door
16 horizontal track
17 vertical track
20 channel
21 retaining bracket
22*a* retaining platform
22*b* first platform aperture
22*c* second platform aperture
23 securing bar bracket
24 pivot point
25 slot
26 side panel
27 rear panel
28 upper panel
29 upper panel aperture
30 releasing bar
31 releasing bar spring
32 releasing bar fastener
33 slot fastener
40 securing bar
41 securing bar spring
42 securing bar spring fastener
43 magnet
50 cradle
51 attachment means

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a concealed security bar for a sliding door (herein described as the "apparatus") 10, which provides a means to secure and unsecure a sliding door 15 in a closed or open position, respectively. Referring now to FIG. 1, an environmental view of the apparatus 10, according to the preferred embodiment of the present invention, is disclosed. The apparatus 10 comprises a channel 20, a releasing bar 30, a securing bar 40, and a cradle 50. The apparatus 10 is positioned between a horizontal track 16 and a vertical track 17 of the sliding door 15 and enables a user to manually activate said apparatus 10 in a secure state, thereby prohibiting said sliding door 15 from opening or manually deactivate said apparatus 10 in an unsecure state, thereby enabling said sliding door 15 to open. The apparatus 10 is preferably utilized on sliding doors 15 measuring approximately five (5) to six (6) feet in height, yet other sizes may be incorporated without limiting the scope of said apparatus 10.

Figure 2:
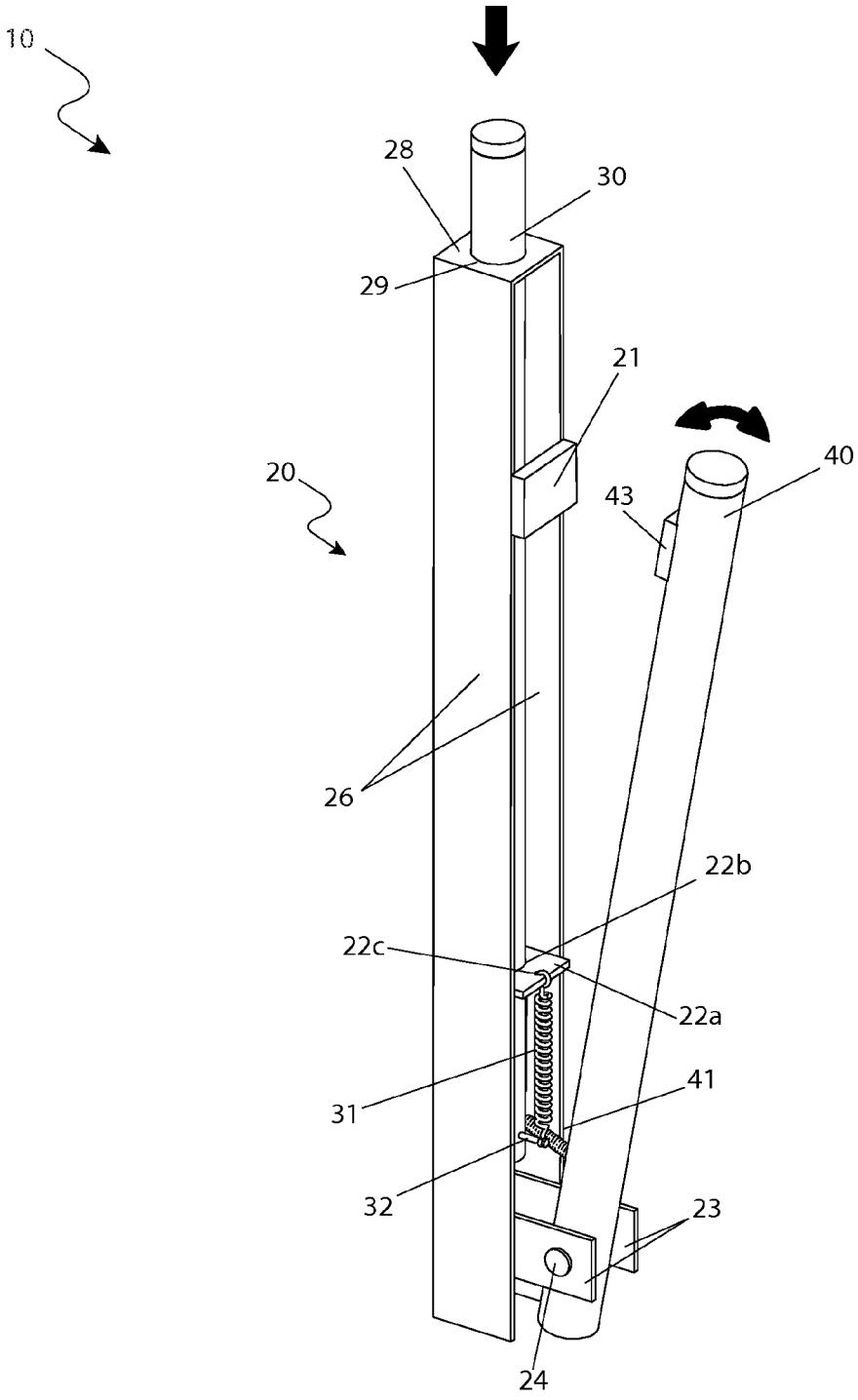
FIG. 2 is a side perspective view of the concealed security bar for a sliding door 10, according to a preferred embodiment of the present invention.
Figure 3:
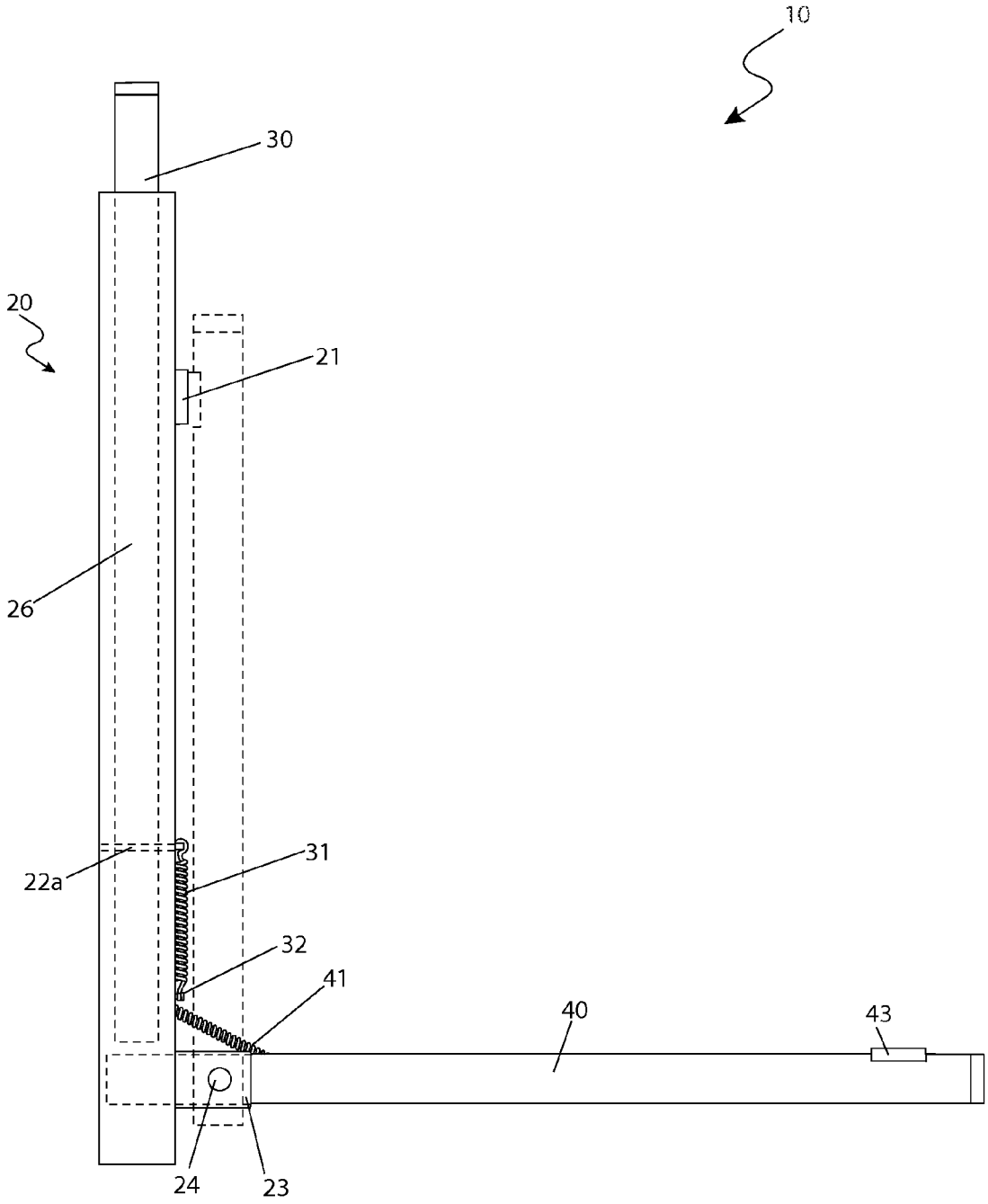
FIG. 3 is a side view of the concealed security bar for a sliding door 10, according to a preferred embodiment of the present invention.
Figure 4:
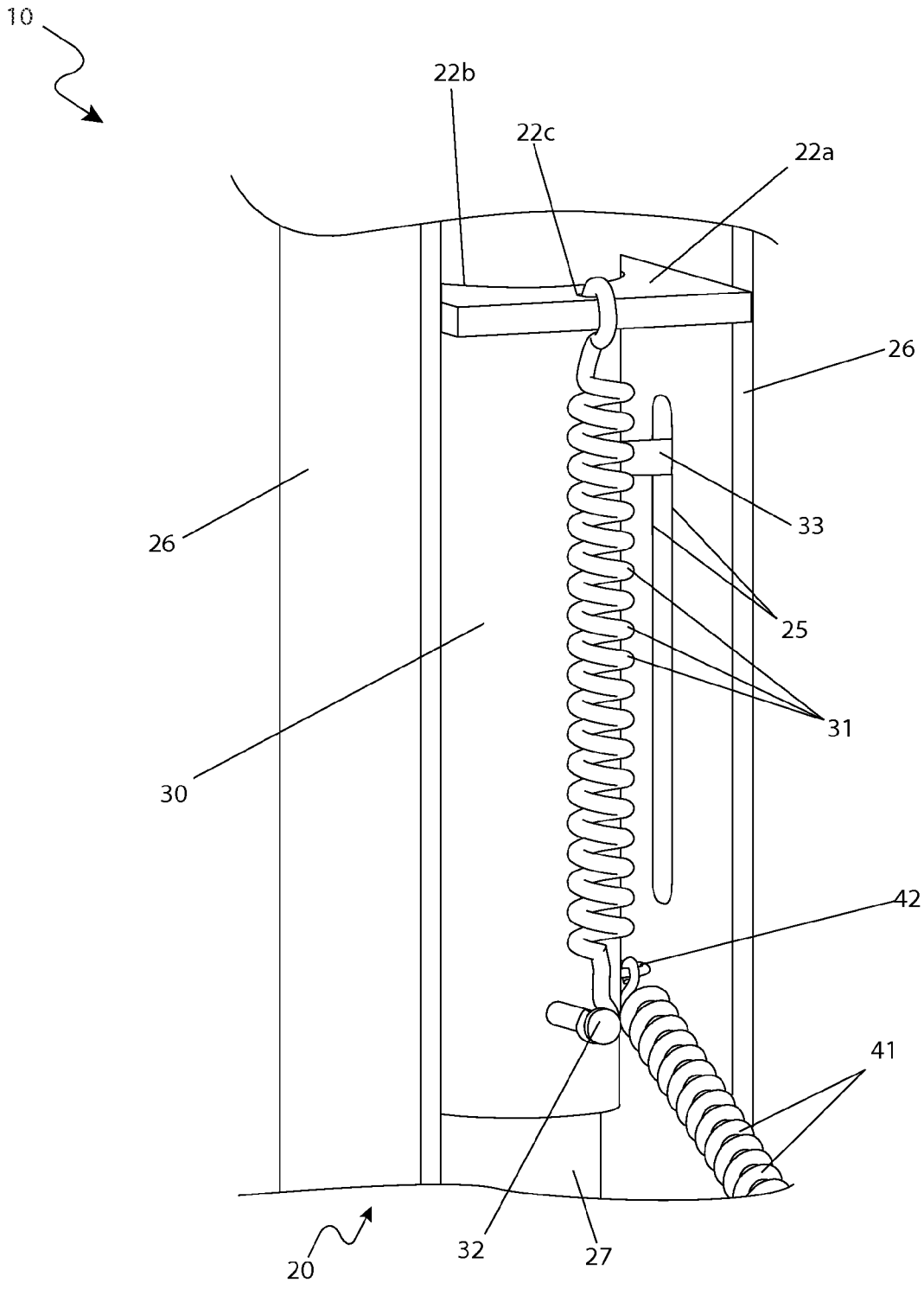
FIG. 4 is a close-up view of the concealed security bar for a sliding door 10, according to a preferred embodiment of the present invention.

Referring now to FIG. 2, a side perspective view of the apparatus 10, FIG. 3, a side view of the apparatus 10, and FIG. 4, a close-up view of the concealed security bar for a sliding door 10, according to the preferred embodiment of the present invention, are disclosed. The apparatus 10 comprises a vertical channel 20 which is orientated in an upright manner and positioned into the vertical track 16 of the sliding door 15 via interference fitting means. The channel 20 is also preferably fastened via an appropriate amount of mechanical fasteners which are placed into the vertical track 16, thereby securing a rear panel 27 of said channel 20 to said vertical track 16. The channel 20 comprises a pair of side panels 26, a rear panel 27, and an upper panel 28. The channel 20 measures approximately thirty-five (35) inches in height, one-and-a-half (1½) inches in width, and one (1) inch in length. The channel 20 is fabricated from heavy-duty durable materials such as, but not limited to: metal, plastic, or the like.

The channel 20 also comprises a retaining bracket 21, a retaining platform 22*a*, and a slot 25 which retains, secures, and guides a releasing bar 30, respectively. The releasing bar 30 is comprised of a rod measuring approximately five-eighths (%) of an inch in diameter and thirty-six (36) inches in length. The releasing bar 30 is fabricated from heavy-duty durable materials such as, but not limited to: wood, plastic, or the like. The releasing bar 30 is slidably inserted through an upper panel aperture 29 which also guides and secures said releasing bar 30 when in use. The upper panel aperture 29 is centrally positioned on the upper panel 28 and comprises a diameter slightly larger than the diameter of the releasing bar 30. The retaining bracket 21 is positioned on an upper front portion of the channel 20 and is preferably integrally molded into the side panels 26. The retaining bracket 21 is comprised of a material which comprises magnetic properties which enables a magnet 43 located on a securing bar 40 to engage and secure to said retaining bracket 21 (see herein below). The retaining bracket 21 secures the releasing bar 30 within the channel 20 and provides a mating means to the securing bar 40. The retaining platform 22*a* also provides an additional means to secure the releasing bar 30 via a first platform aperture 22*b* and provides a securing means to a releasing bar spring 31 via a second platform aperture 22*c* (see FIG. 4). The retaining platform 22*a* is positioned horizontally within the channel 20 and is integrally molded to each side panel 26 and rear panel 27. The first platform aperture 22*b* is centrally positioned on the retaining platform 22*a* and enables the releasing bar 30 to be slidably inserted within which provides additional guiding and securing means to said releasing bar 30. The second platform aperture 22*c* is located parallel to the first platform aperture 22*b* and enables a distal end of the releasing bar spring 31 to be suspended in a hooking-type fashion. A proximal end of the releasing bar spring 31 is connected to a releasing bar fastener 32 which is located on an outer surface of a lower portion of the releasing bar 30. The releasing bar fastener 32 is preferably a mechanical fastener such as a screw which is fastened into a front lower surface of the releasing bar 30. The releasing bar spring 31 enables the releasing bar 30 to comprise an elastic feature which enables said releasing bar 30 to maintain a force between the retaining platform 22*a* and the releasing bar fastener 32 and further enable the releasing bar 30 to come back to a resting state after being depressed. The releasing bar spring 31 is preferably a compression coiled spring measuring approximately three (3) inches in length and one-quarter (¼) of an inch in diameter, yet other mechanical springs comprising differing dimensions may be utilized without limiting the scope of the apparatus 10.

The channel 20 also comprises a slot 25 which provides a means to limit the lateral and vertical movement of the releasing bar 30 as it is being depressed to retract the securing bar 40. The slot 25 is located on a side panel 26 between the retaining platform 22*a* and the releasing bar fastener 32 and measures approximately one-eighth (%) of an inch in width by two-and-a-quarter (2¼) inches in length. The releasing bar 30 is connected to the slot 25 via a slot fastener 33 inserted into said slot 25 from an outer surface of the respective side panel 26 to engage said releasing bar 30. As the releasing bar 30 is depressed the downward movement is limited as the slot fastener 33 engages a proximal portion of the slot 25; similarly, the upward movement is limited as the slot fastener 33 engages a distal portion of said slot 25, and the axial movement of said releasing bar 30 is limited via the width of said slot 25.

Figure 5A:
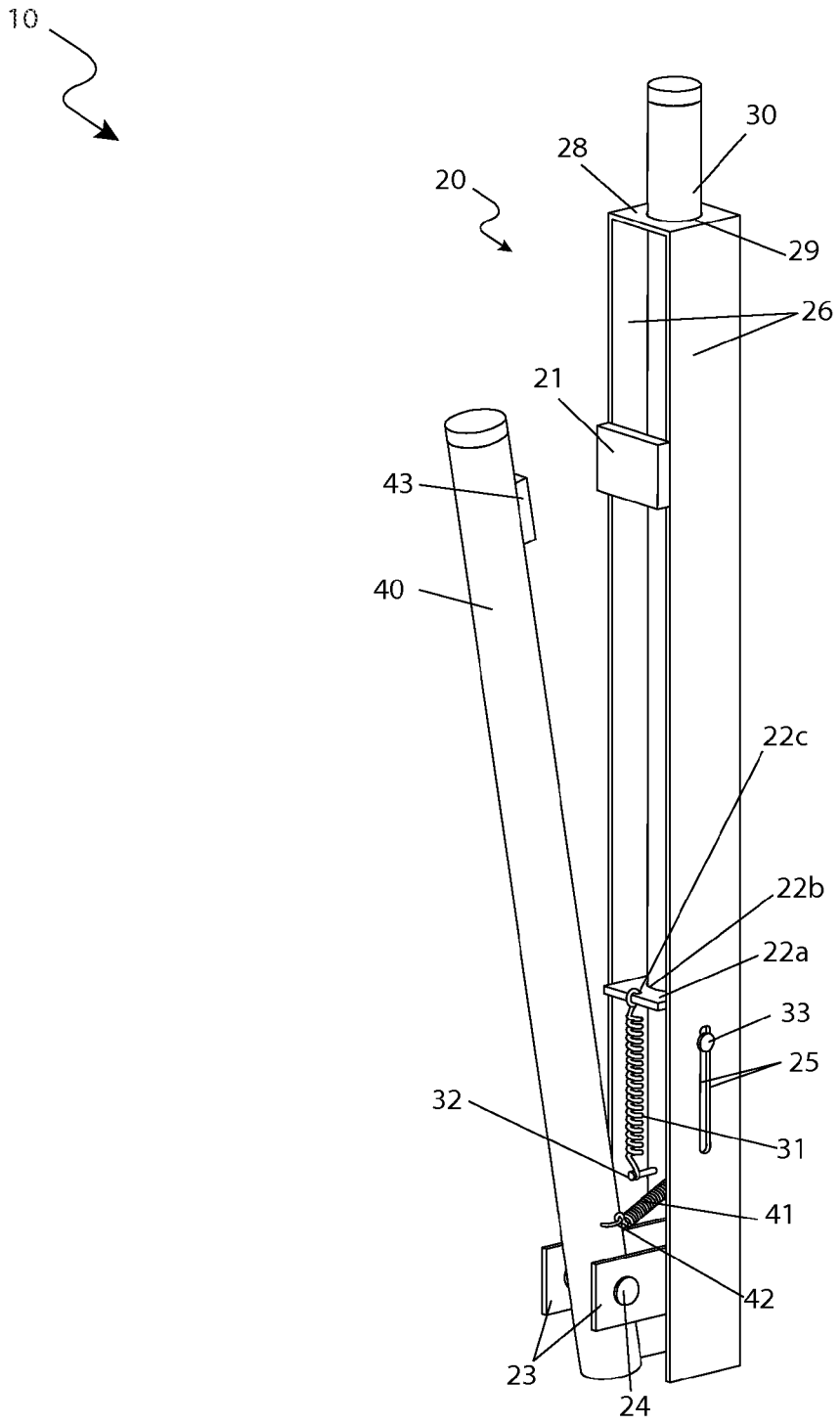
FIG. 5*a* is an opposing side perspective view of the concealed security bar for a sliding door 10 depicting an unsecure state, according to a preferred embodiment of the present invention.
Figure 5B:
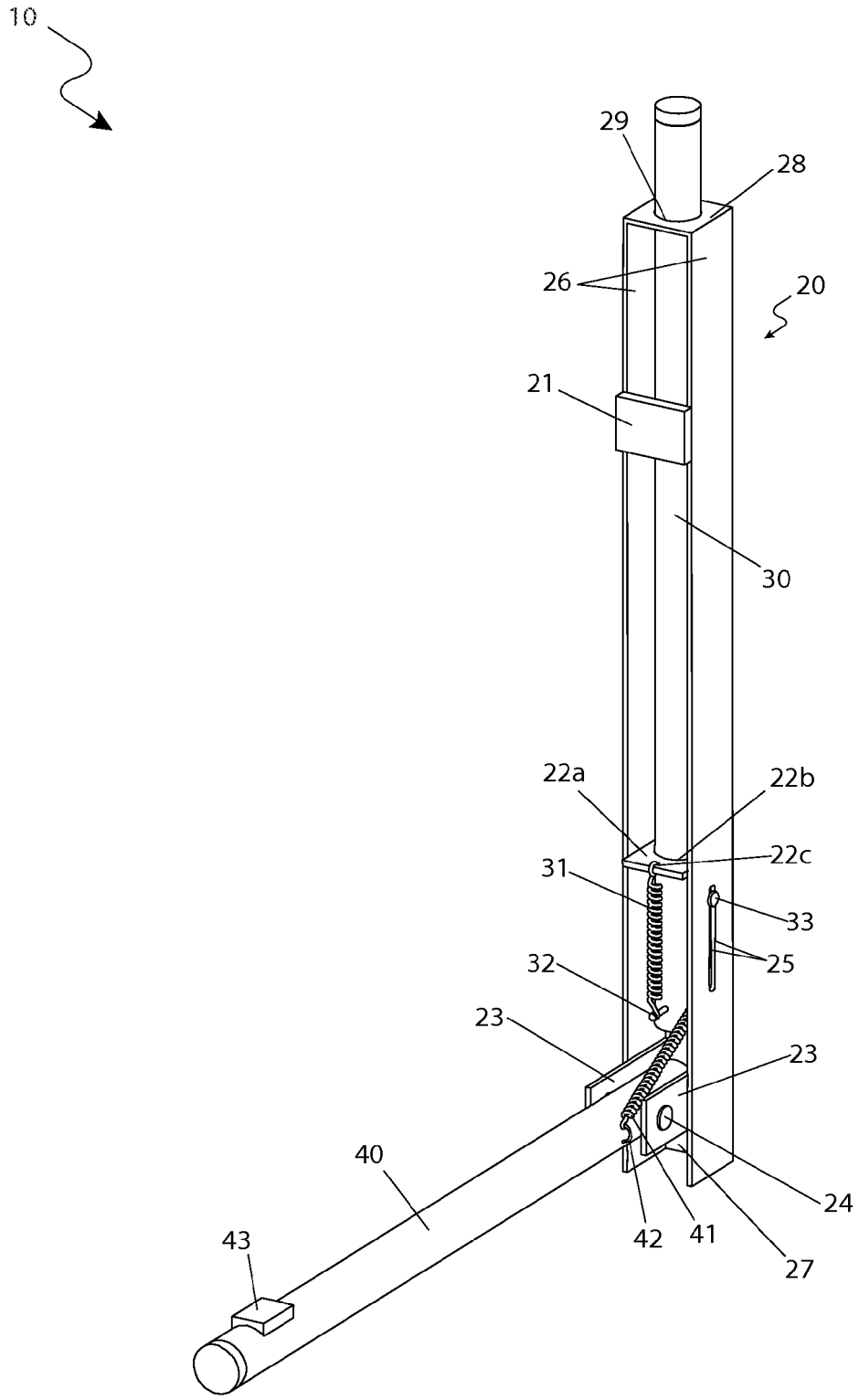
FIG. 5*b* is another opposing side perspective view of the concealed security bar for a sliding door 10 depicting a secure state, according to a preferred embodiment of the present invention; and, FIG. 6 is a perspective view of a cradle 50, according to a preferred embodiment of the present invention.

Referring now to FIG. 5*a*, an opposing side perspective view of the apparatus 10 and FIG. 5*b*, another opposing side perspective view of the apparatus 10, according to the preferred embodiment of the present invention, are disclosed. The apparatus 10 comprises a securing bar 40 which provides a means to prohibit or allow the sliding door 15 to close or open, respectively. The securing bar 40 is pivotally attached to a lower portion of the channel 20 via a pair of securing bar brackets 23 and a pivot point 24. The securing bar brackets 23 are orientated in a parallel manner and extend perpendicularly from the side panels 26. Each securing bar bracket 23 comprises a pivot point 24 which further comprises an axle pin and washers to enable the securing bar 40 to pivot about said pivot point 24 from a vertical to a horizontal position. The channel 20 extends approximately two (2) inches beyond the securing bar brackets 23 which enables the securing bar 40 to rotate appropriately within said channel 20 from the vertical to the horizontal position. The securing bar 40 is also attached to the releasing bar 30 via a securing bar spring 41 which enables said securing bar 40 to be in mechanical communication with said releasing bar 30. The securing bar spring 41 is attached to a proximal portion of the securing bar 40 and a proximal portion of the releasing bar 30 via a securing bar spring fastener 42 which is preferably an integrally molded "U"-shaped hook which accepts the end portions of the securing bar spring 41. The securing bar spring 41 is comprised of a one-and-a-quarter (1¼) inch diameter compression coil spring which assists the securing bar 40 to be activated and deactivated. A proximal portion of the securing bar 40, when in the activated state, is positioned below the releasing bar 30 in a perpendicular manner. As the releasing bar 30 is depressed, the securing bar spring 41 pulls the securing bar 40 upwardly into an upright position.

The securing bar 40 also comprises a magnet 43 which engages the retaining bracket 21 as abovementioned. The magnet 43 is located on an outer inwardly positioned distal surface of the securing bar 40 such that it aligns with the retaining bracket 21 when oriented in an upright position. The magnet 43 provides a means to secure the securing bar 40 when in the deactivated position when enables the sliding door 15 to be opened.

Figure 6:
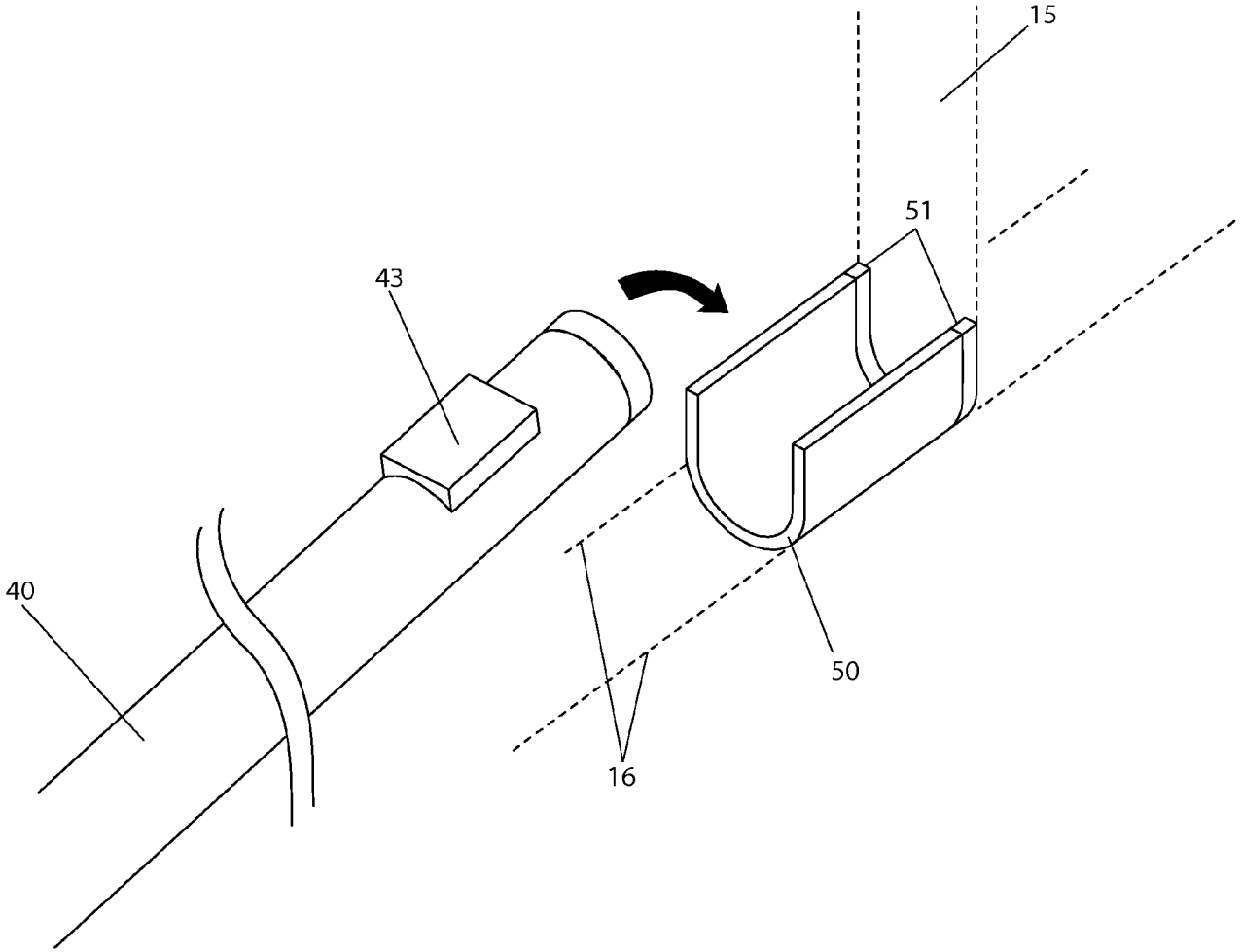

Referring now to FIG. 6, a perspective view of a cradle 50, according to the preferred embodiment of the present invention, is disclosed. The apparatus 10 also comprises a cradle 50 which provides a level resting position for the securing bar 40 when in an activated horizontal position. The cradle 50 comprises a "U"-shape which enables the securing bar 40 to rest within. The cradle 50 is comprised of materials such as, but not limited to: plastic, foam rubber, or the like. The cradle 50 is attached to a lower lateral surface of the sliding door 15 via an attachment means 51 such as, but not limited to: adhesive, hook-and-loop fastener, or the like.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 through 6.

The method of installing and utilizing the apparatus 10 may be achieved by performing the following steps: acquiring the apparatus 10; positioning the channel 20 in an upright manner within a vertical track 17 of the sliding door 15 and fastening as desired; attaching the cradle 50 to a lower portion of the sliding door 15 via the attachment means 51 which enables the securing bar 40 to lay in a level horizontal orientation; activating the securing bar 40 via pushing said securing bar 40 to disengage the magnet 43 from the retaining bracket 21 to a downward horizontal position; enabling the securing bar 40 to lay within the cradle 50 and prohibit the sliding door 15 from opening; deactivating the securing bar 40 via depressing the releasing bar 30 which pulls the securing bar 40 upwardly to an upright position via the securing bar spring 41, thereby enabling the magnet 43 to engage the retaining bracket 21 and the releasing bar spring 31 to position the releasing bar 30 in an original position; and, utilizing of the apparatus 10 to secure and unsecure sliding doors 15 in a safe and functional manner.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A sliding door security bar to be positioned between a horizontal track and a vertical track of a sliding door for securing and unsecuring the sliding door between closed and open position respectively, said sliding door security bar comprising:

a channel capable of being positioned in an upright manner into the vertical track of the sliding door, comprising:

a plurality of side panels;

a rear panel capable of being secured to the vertical track;

an upper panel having a centrally positioned aperture;

a retaining bracket attached to said side panels;

a retaining platform positioned horizontally within said channel;

a slot located in one of said side panels; and, a plurality of securing bar brackets extending perpendicularly from said side panels and a lower portion of said channel respectively;

a releasing bar located within said channel;

a releasing bar spring attached to said releasing bar and said channel respectively;

a securing bar pivotally connected to said releasing bar; and, a securing bar spring connected to said releasing and securing bars respectively;

wherein said releasing bar is slidably inserted through said aperture.

2. The sliding door security bar of claim 1, wherein said retaining platform comprises:

a first platform aperture centrally positioned in said retaining platform; and, a second platform aperture located parallel to said first platform aperture;

wherein said releasing bar passes through said first platform aperture; and, wherein said releasing bar spring is secured to said second platform aperture.

3. The sliding door security bar of claim 2, wherein said releasing bar spring maintains a tensional force between said retaining platform and said releasing bar thereby causing said releasing bar to return to a resting state after being downwardly depressed;

wherein said securing bar spring is attached to an end portion of said securing bar and an end portion of said releasing bar respectively.

4. The sliding door security bar of claim 1, wherein said releasing bar comprises: a slot fastener attached to said releasing bar and inserted into said slot respectively, wherein said slot is located between said retaining platform and said retaining brackets.

5. The sliding door security bar of claim 4, wherein a downward movement of said releasing bar is limited when said slot fastener engages a proximal portion of said slot;

wherein an upward movement of said releasing bar is limited when said slot fastener engages a distal portion of said slot.

6. The sliding door security bar of claim 1, wherein said securing bar comprises:

a magnet located on an outer distal surface of said securing bar; and, an axle pin attached to said channel and said securing bar;

wherein said securing bar pivots about said axle pin between vertical and horizontal positions; and, wherein said magnet engages said retaining bracket when said securing bar is oriented in an upright position.

7. The sliding door security bar of claim 1, wherein a proximal portion of said securing bar is positioned below said releasing bar in a perpendicular manner when said securing bar is pivoted to a horizontal position relative to said releasing bar.

8. The sliding door security bar of claim 1, further comprising: a cradle capable of receiving said securing bar at a horizontal position.

9. A sliding door security bar to be positioned between a horizontal track and a vertical track of a sliding door for securing and unsecuring the sliding door between closed and open position respectively, said sliding door security bar comprising:

a channel capable of being positioned in an upright manner into the vertical track of the sliding door, comprising:

a plurality of side panels;

a rear panel capable of being secured to the vertical track;

an upper panel having a centrally positioned aperture;

a retaining bracket attached to said side panels;

a retaining platform positioned horizontally within said channel;

a slot located in one of said side panels; and, a plurality of securing bar brackets extending perpendicularly from said side panels and a lower portion of said channel respectively;

a releasing bar located within said channel;

a releasing bar spring attached to said releasing bar and said channel respectively;

a securing bar pivotally connected to said releasing bar; and, a securing bar spring connected to said releasing and securing bars respectively;

wherein said releasing bar is slidably inserted through said aperture;

and, wherein said securing bar spring upwardly pulls said securing bar into an upright position when said releasing bar is depressed.

10. The sliding door security bar of claim 9, wherein said retaining platform comprises:

a first platform aperture centrally positioned in said retaining platform; and, a second platform aperture located parallel to said first platform aperture;

wherein said releasing bar passes through said first platform aperture; and, wherein said releasing bar spring is secured to said second platform aperture.

11. The sliding door security bar of claim 10, wherein said releasing bar spring maintains a tensional force between said retaining platform and said releasing bar thereby causing said releasing bar to return to a resting state after being downwardly depressed;

wherein said securing bar spring is attached to an end portion of said securing bar and an end portion of said releasing bar respectively.

12. The sliding door security bar of claim 9, wherein said releasing bar comprises: a slot fastener attached to said releasing bar and inserted into said slot respectively, wherein said slot is located between said retaining platform and said retaining brackets.

13. The sliding door security bar of claim 12, wherein a downward movement of said releasing bar is limited when said slot fastener engages a proximal portion of said slot;

wherein an upward movement of said releasing bar is limited when said slot fastener engages a distal portion of said slot.

14. The sliding door security bar of claim 9, wherein said securing bar comprises:

a magnet located on an outer distal surface of said securing bar; and, an axle pin attached to said channel and said securing bar;

wherein said securing bar pivots about said axle pin between vertical and horizontal positions; and, wherein said magnet engages said retaining bracket when said securing bar is oriented in an upright position.

15. The sliding door security bar of claim 9, wherein a proximal portion of said securing bar is positioned below said releasing bar in a perpendicular manner when said securing bar is pivoted to a horizontal position relative to said releasing bar.

16. The sliding door security bar of claim 9, further comprising: a cradle capable of receiving said securing bar at a horizontal position.

* * * * *